US005701545A

United States Patent [19]

Fyson et al.

[11] Patent Number: 5,701,545

[45] Date of Patent: Dec. 23, 1997

[54] PHOTOGRAPHIC PROCESSING

[75] Inventors: John Richard Fyson, Hackney; Christopher Barrie Rider, New Malden; Philip Coldrick, Hayes; Janet Linda Menton, Pinner, all of United Kingdom

[73] Assignee: Eastman Kodak Company, Rochester, N.Y.

[21] Appl. No.: 642,096

[22] Filed: May 2, 1996

[30] Foreign Application Priority Data

May 4, 1995 [GB] United Kingdom ..... 9509039

[51] Int. Cl.[6] ..... G03D 3/02

[52] U.S. Cl. ..... 396/626

[58] Field of Search ..... 396/567, 568, 396/569, 570, 578, 604, 610, 617, 620, 622, 624, 626, 630; 430/30, 398, 399, 400; 235/449; 134/64 R, 64 P, 122 R, 122 P

[56] References Cited

U.S. PATENT DOCUMENTS

| | | | |
|---|---|---|---|
| Re. 30,123 | 10/1979 | Crowell et al. | 396/564 |
| 3,849,660 | 11/1974 | Hommerin | 235/449 |
| 4,402,590 | 9/1983 | Rubin | 396/630 |
| 4,469,424 | 9/1984 | Matsui et al. | 396/570 |
| 4,486,082 | 12/1984 | Wagner et al. | 396/570 |
| 4,527,878 | 7/1985 | Taniguchi et al. | 396/569 |
| 5,073,464 | 12/1991 | Osawa et al. | 430/30 |
| 5,180,648 | 1/1993 | Nakamura | 430/21 |
| 5,235,369 | 8/1993 | Nakamura et al. | 396/569 |
| 5,315,337 | 5/1994 | Skye | 396/569 |

FOREIGN PATENT DOCUMENTS

| | | | |
|---|---|---|---|
| 0 456 684 | 8/1990 | European Pat. Off. | G03C 5/31 |
| 0 500 278 | 8/1992 | European Pat. Off. | G03D 3/06 |
| 58-027144 | 2/1983 | Japan | G03D 3/06 |
| 93/03415 | 2/1993 | WIPO | G03C 5/31 |
| 93/03416 | 2/1993 | WIPO | G03C 5/31 |

*Primary Examiner*—D. Rutledge
*Attorney, Agent, or Firm*—J. Lanny Tucker

[57] ABSTRACT

Photographic materials are processed using a processing solution that is replenished at a rate controlled by an algorithm that has terms determined by information associated with the photographic material.

18 Claims, No Drawings

PHOTOGRAPHIC PROCESSING

FIELD OF THE INVENTION

The invention relates to photographic processing. More particularly, it relates to the replenishment of a processing solution used in the processing of a photographic material.

BACKGROUND OF THE INVENTION

As the chemicals in the baths of a photographic processor are used up, replenishment chemicals must be added to the baths in order to keep the activities and concentrations of the chemicals constant.

The amount of replenishment is dependent on many factors, e.g., light exposure given to the photographic material, the properties of the photographic material and the ability of the replenisher to restore a process tank solution to its aim concentration.

The replenishment of a process is often carried out automatically. This may be accomplished by using an algorithm which may be dependent on area alone as practiced in most automatic processing machines; or it may be dependent on exposure as described in EP-A-0,596,994; U.S. Pat. No. 5,235,369; EP-A-0,500,278; EP-A-0,456,684 and U.S. Pat. No. 4,486,082 or by the amount of silver developed in a black and white system as taught by EP-A-0,596,991, U.S. Pat. Nos. 5,315,337, 5,073,464, GB-A-2,108,707 and GB-A-2,106,666.

The ability of the replenisher to restore a process tank solution to its aim concentration may be variable because of variation in the composition of the photographic material. The composition of a photographic material might be changed to improve performance. For example, silver laydown, i.e., the silver coating weight might be increased to get better image quality. Alternatively, silver laydown might be decreased in order to reduce the amount of silver entering the environment on processing. Often, such changes are transparent to the user of the photographic material but would affect the amount of replenisher that is needed to replenish accurately the tanks in which the material is processed. It is also possible that the silver laydown is kept constant but there is a change in its developability leading to a different requirement for replenishment.

A variation in photographic material composition could be notified to the user by a leaflet suggesting a change be made to the setting of the replenishment pumps. This means that if materials come in as a mixture of old and new forms the replenishment rate has to be reset manually or the products segregated for processing in machines with different replenishment characteristics. This is costly, time consuming and inconvenient. It also might lead to errors being made, e.g., by forgetting to change the replenishment rate.

SUMMARY OF THE INVENTION

The invention provides a method of processing a photographic material in a photographic processing apparatus comprising contacting the material with a processing solution, and replenishing the processing solution with replenishment chemistry at a rate that is controlled by using an algorithm wherein at least one of the terms of the algorithm is determined by information associated with the photographic material.

Variations in the composition of the photographic material being processed are taken into account in a convenient manner to provide replenishment and hold the processing tank activity constant.

DETAILED DESCRIPTION OF THE INVENTION

Replenishment of a processing solution may be controlled as a function of one or more parameters relating to the photographic material being processed and/or the process itself. For example, such parameters include the area of the photographic material, the degree to which the material is exposed to activating radiation and the amount of silver developed. Terms representing these parameters are contained in an algorithm or look-up table which is used to determine the rate of replenishment required.

In accordance with the invention, replenishment is controlled as a function of a parameter relating to the photographic material, i.e., the algorithm or look-up table comprises a term representing that parameter. Information representing that parameter is associated with the photographic material. At least one of the terms of the algorithm or look-up table used to determine the rate of replenishment is determined by the information associated with the photographic material.

The method of the invention can be used to control the replenishment rate of more than one processing solution. Replenishment chemistry is added to each processing solution and the replenishment rate for each solution is controlled using an algorithm wherein at least one of the terms of the algorithm is determined by information associated with the photographic material.

The replenishment chemistry may be fixer, wash, stabilizer, bleach or bleach-fix replenishment chemistry.

The method of the invention can be used in the processing of a variety of silver halide photographic materials including both color and black and white materials. Examples of such materials are described in *Research Disclosure,* September 1994, Number 365 published by Kenneth Mason Publications Limited, (hereinafter referred to as *Research Disclosure*), Section I.

For example, the invention may be applied to the processing of graphic arts materials, i.e., high contrast, black and white materials. The silver halide can be bromoiodide, chlorobromoiodide, bromide, chlorobromide, or chloride. A preferred silver halide emulsion layer has a silver chloride content of at least 50%. The photosensitive silver halide emulsions employed in these high contrast materials may contain both silver bromide and silver iodide in addition to the silver chloride. Preferably the silver iodide content is less than 10 mol %. Substantially pure silver chloride emulsions may be used although the preferred emulsions comprise 70 mol % silver chloride and 30 mol % silver bromide.

In a particular embodiment, the photographic material may be a nucleated or rapid access material, e.g., for use in an imagesetter. Typically, such materials comprise silver chloride or silver chlorobromide emulsions in which the silver coating weight is from 1 to 10 g/m$^2$ and the contrast index is from 1 to 30.

Emulsions containing hydrazide nucleating agents may be used. These emulsions can be processed in a developer with conventional amounts of sulfite, hydroquinone and possibly metol or a pyrazolidone. Such developers also contain an amine additive as described in U.S. Pat. No. 4,269,929. Other developers containing amines are described in U.S. Pat. Nos. 4,668,605 and 4,740,452.

Many hydrazides have been proposed for use in such materials, for example, in U.S. Pat. Nos. 4,323,643, 4,278,748, 4,031,127, 4,030,925 and in EP-A-0,333,435.

More recently, it has been proposed to incorporate amine boosters in high contrast materials with the advantage that it is not necessary to have a special developer in order to obtain the very high contrast that is demanded by much graphic arts work. Such amine boosters are described in JP-140340/85 and 222241/87 and in EP-A-0,364,166.

Preferably, the emulsion layer comprises two or more emulsion grain types. For example, more than one type of latent image-forming grain may be present. Grains sensitive to different regions of the spectrum may thus be used providing a material suitable for more than one exposing radiation type. When there are grains present which are sensitized to distinct wavelength ranges and exposure is to a source of limited wavelength, some of the sensitized grains will not respond to this wavelength and are thus non-latent image forming grains under these conditions of use.

The information associated with the photographic material may represent a variety of photographic material parameters, e.g., silver coverage, silver halide ratio, gelatin coverage, coupler coverage and inhibitor coverage.

The information can be associated with the photographic material in a number of ways. For example, the information may be present on a container or packaging in which the photographic material is supplied. Alternatively, the information may be present on separate identification means provided with the photographic material, e.g., a card or sheet displaying the information, a magnetic storage medium, e.g., a floppy disk holding the information or a "smartcard" which incorporates an integrated circuit containing the information.

Alternatively, the information associated with the photographic material may be on the photographic material. For example, the information may be carried on a label attached to the photographic material or the information may be on the material itself. The information could be magnetically recorded on a photographic material provided with a magnetic recording layer. The information could be recorded so that it appears on processing, e.g., a latent image barcode.

The information may be in any suitable form. It might be visibly presented, e.g., in the form of numbers or letters. Such information can be read and entered manually in a replenishment chemistry management system. Alternatively, the information may be machine-readable, e.g., in the form of a bar-code or a magnetic stripe.

The invention may be employed in any photographic processing apparatus. Such apparatus may include means for imagewise exposing a photographic material and means for processing the exposed material to produce the recorded image. The processing means will normally provide a combination of processing stages selected from development, fixing, bleaching and washing stages depending on the type of material being processed.

Any photographic processor known in the art can be used to process the photosensitive materials described herein. For example, large volume processors, and so-called minilab and microlab processors may be used. Other examples include the Low Volume Thin Tank processors described in such references as WO 92/10790, WO 92/17819, WO 93/04404, WO 92/17370, WO 91/19226, WO 91/12567 and U.S. Pat. No. 5,436,118.

Photographic processing solutions for development, fixing, bleaching, washing, rinsing and stabilizing and their use are described in *Research Disclosure,* Sections XIX and XX.

The composition of the replenishment solution will depend on the processing solution. For example, a developer replenishment solution may have the same composition as the developer or it may be a more concentrated version thereof.

The replenishment of a processing solution, e.g., a developer solution may be carried out manually or, preferably, by other controlled means of addition. A preferred means for controlling the supply of replenisher is a chemical management system comprising a computer which calculates the amount of replenishment required in accordance with the algorithm or look-up table. In order to do this, the computer receives signals representing the terms used in the algorithm. In addition to the term determined by the information associated with the photographic material, the algorithm may comprise other terms, e.g., terms relating to the degree of exposure of the photographic material and the area of material processed.

An exposure term in the algorithm may be determined by obtaining information from the exposure device, by visual estimation or, if replenishment is made for the material after processing, by scanning the final image and using a density to exposure function.

An area term can be obtained by recording the number of sheets of known area being processed or by timing the passage of material of known width through the processor.

The algorithm or look-up table may also have additional terms, e.g., relating to the rate of oxidation of the developer and solution evaporation in a particular processor. These rates would be determined by measurement or by models considering the geometry of the processor.

The algorithms or look-up tables may be determined by experiment or by model calculations.

The computer in the chemical management system may be used to control the operation of a pump supplying replenisher to a tank of process solution. For example, by timing the operation of the pump a desired amount of replenisher can be added.

In a specific embodiment of the invention, a high contrast silver halide film, e.g., KODAK™ FOCUS™ HeNe film is exposed by a scanning laser in an imagesetter, e.g., a HERKULES™ imagesetter (Linotype-Hell AG). Appropriate hardware and software is used to calculate the number of exposed pixels per page, i.e., a signal is derived which is indicative of the exposure of the film.

The imagesetter is provided with a bar-code reading wand and a bar-code decoder. Information contained in a bar-code on the packaging of the photographic film which includes the replenishment algorithm parameter is read using the wand attached to the imagesetter.

The exposed film is conveyed to a processor, e.g., a MULTILINE™ 550 processor (Glunz & Jensen International A/S) which provides a four stage (develop/fix/wash/dry) rapid access process. The processor comprises a chemical management system including a computer that calculates and supplies the required amount of developer replenisher based on information received relating to the exposure of the photographic material, photographic film parameters and processor usage. A communication link is provided between the imagesetter and the processor so that the exposure information and silver laydown information generated in the imagesetter can be provided to the chemical management system. Information relating to the average amount of photographic material processed in unit time can be generated in the processor from sensors that detect the number of sheets of a given area passing through the processor in a given time.

The invention is further illustrated by way of example as follows.

Example 1

Two versions of an ISO 400 speed silver halide color photographic film are made, one containing 4.1 g/m$^2$ silver and the other containing 6.3 g/m$^2$ silver. This information is printed in the form of a bar-code on the 35 mm film cassette. It had previously been determined by experiment that the replenishment rates for the developer for the films could be related to the silver coating weight according to the following algorithm:

Developer replenishment rate=7.7[Ag] ml/meter length 35 mm film wherein [Ag]is the coating weight of silver on the film in g/m$^2$.

A mixture of the films was processed in a KODAK™ Model 25 Minilab film processor filled with C-41 chemistry. Before each film was put through the processor, its coating weight was read using a bar-code reader from the cassette into the computer controlling the replenishment. The replenishment for each film was calculated according to the formula given above. It was found that the bromide concentration in the processor, which largely determines the activity of the developer remained constant.

Example 2

A bar-code label is stuck to a cassette of high contrast silver halide imagesetter film, a black and white graphic arts film. Two digits of the bar-code are set aside to hold encoded silver coating weight data. The encoding for the FACTOR is as follow:

FACTOR=15.2 [Ag] rounded to the nearest integer.

This bar-code associated with the film packaging is read using a bar-code wand attached to the imagesetter. The bar-code information is decoded by the imagesetter and is relayed to a graphic arts processor fitted with a replenishment control computer, to which it is attached, by an electronic connection using an appropriate protocol. The computer in the processor controls the replenishment rate of the developer, fixer and wash. Information regarding the percentage exposure of the film is also sent to the processor computer that stores information relating to the last time that a sheet of film was processed along with its area in order to calculate the processor utilization, e.g., area processed/unit time. The computer computes the replenishment rates according to the following formula:

Replenishment rate=−3+0.0752*FACTOR*EXP+1465*AREA−15621*AREA$^2$ ml/m$^2$ wherein EXP=exposure in %, AREA=(Last sheet area in meters$^2$ )/(time since start of the last sheet in minutes), and

* is a multiplication sign.

If AREA>0.10 then AREA is set to 0.10.

In order to save processor time the effect of processing films with coating weight 3.3 g Ag/m$^2$ (factor 50) and coating weight 2.8 g Ag/m$^2$was simulated using the following model.

Definitions for model:

Mass in—the mass of a component entering the process tank in unit time(e.g., g/day)

Mass out—the mass of a component leaving the process tank in unit time(e.g., g/day)

Volume in—the volume of liquid entering the process tank in unit time(e.g., ml/day)

Volume out—the volume of liquid leaving the process tank in unit time(e.g., ml/day)

Usage—the amount of the component being considered that is consumed by 1 m$^2$ of material (a positive number indicates a loss of material)(e.g., g/m$^2$)

Tank conc—the concentration of the component being considered in the processor tank(e.g., g/l)

Tank conc initial—the concentration of the component being considered at time=0 (e.g., g/l)

Area—the area of photographic material processed in unit time(e.g., m$^2$/day)

Rep rate—replenishment rate per unit area(e.g., ml/l)

Anti ox—volume of additional replenisher added per unit time that is independent of processed area (sometimes known as time dependent replenishment (TDR))(e.g., ml/day)

Top up—Additional volume of replenisher added to tank at the beginning of unit time to make up for evaporation. This is set to zero in mass equations only if top-up is with water(e.g., ml/day)

Time—the time elapsed in appropriate units (e.g., days)

Overflow mass—mass of component lost by tank overflow to drain in unit time (e.g., g/day)

Overflow vol—volume of liquid lost by tank overflow to drain in unit time(e.g., ml/day)

Carryout mass—mass of component carried out on material web in unit time (e.g., ml/day)

Carryout vol—volume of liquid carried out on material web in unit time (e.g., ml/day)

Oxidation—the total mass of the component being considered lost in unit time(tank size dependent)(e.g., g/tank/day)

Evaporation—the volume of liquid lost from the processing tank being considered in unit time (e.g., ml/tank/day)

Tank volume—the volume of the tank being considered (e.g., ml)

The Model:

Mass in=(Area*Rep rate+Anti ox+Top up)*Rep conc

Volume in=Area*Rep rate+Anti ox+Top up

Mass out=(Carryout mass+Overflow mass)+Area*Usage+Oxidation

Volume out=(Carryout vol+Overflow vol)+Evaporation

Rate of change of mass with time=(Area*Rep rate+Anti ox+Top up)*Rep conc−(Carryout mass+Overflow mass)−Area*Usage−Oxidation If Volume in=Volume out (Carryout vol+Overflow vol)=Area*Rep rate+Anti ox+Top up−Evaporation (Carryout mass+Overflow mass)=(Carryout vol+Overflow vol)*Tank conc (Carryout mass+Overflow mass)=(Area*Rep rate+Anti ox+Top up−Evaporation) * Tank conc Rate of change of mass with time=(Area*Rep rate+Anti ox+Top up)*Rep conc−Area*Usage−Oxidation −(Area*Rep rate+Anti ox+Top up−Evaporation) * Tank conc Let a=(Area*Rep rate+Anti ox+Top up)*Rep conc−Area*Usage−Oxidation Let b=(Area*Rep rate+Anti ox+Top up−Evaporation)

Rate of change of mass with time=a−b*Tank conc

Rate of change of concentration with time=(a−b*Tank conc)/Tank volume

Integrating with respect to the limits

Tank Conc=(a−(a−b*Tank conc initial)*exp((−b*time)/tank volume))/b

When time is infinite, i.e., a totally seasoned process, Tank conc=a/b

A developer replenisher of the following formula was used with 50% exposure of KODAK™ IMAGELITE™ LD film and 20 m$^2$of film processed per day:

| | |
|---|---|
| Hydroquinone | 33 g/l |
| Sodium bromide | 1.9 g/l |
| Hydroxymethyl methyl phenidone | 0.8 g/l |

-continued

| | |
|---|---|
| Benzotriazole | 0.22 g/l |
| Phenyl mercapto tetrazole | 0.013 mg/l |
| Sodium metabisulfite | 42 g/l |
| Diethylene glycol | 35 ml/l |
| Potassium carbonate (47%) | 42 g/l |
| pH | 10.56 |

The starting solution had the following composition:

| | |
|---|---|
| Hydroquinone (HQ) | 25 g/l |
| Sodium bromide | 3.8 g/l |
| Hydroxymethyl methyl phenidone | 0.8 g/l |
| Benzotriazole (BTAZ) | 0.20 g/l |
| Phenyl mercapto tetrazole | 0.013 mg/l |
| Sodium metabisulfite | 38 g/l |
| Diethylene glycol | 35 ml/l |
| Potassium carbonate (47%) | 42 g/l |
| pH | 10.56 |

The fully seasoned equilibrium sodium bromide levels were both 3.8 g/l and both replenished tank solutions had pH 10.4 showing that the replenishment algorithm could give steady bromide and pH levels for films with different silver coating weights.

The information was also used to modify a fixer replenisher algorithm as follows:

For exposures<50%:

Fixer replenisher rate=FACTOR(3.75–0.003* EXP) ml/m$^2$

For exposures>50%:

Fixer replenisher rate=3*FACTOR ml/sq.m

The composition of the fixer and fixer replenisher solutions is as follows:

| | |
|---|---|
| Ammonium thiosulfate | 146 g/l |
| Sodium sulfite | 20 g/l |
| Acetic acid | 30 g/l |
| pH adjusted to 6.0 with NaOH | |

The invention has been described in detail with particular reference to preferred embodiments thereof, but it will be understood that variations and modifications can be effected within the spirit and scope of the invention.

We claim:

1. A method of processing a photographic material in a photographic processing apparatus comprising contacting said material with a processing solution, and replenishing said processing solution with replenishment chemistry at a rate that is controlled by using an algorithm wherein at least one of the terms of said algorithm is determined by information associated with said photographic material, which information is silver coverage, silver halide ratio, gelatin coverage, coupler coverage, or inhibitor coverage.

2. The method of claim 1 comprising controlling the replenishment rate of more than one processing solution using an algorithm.

3. The method of claim 1 wherein said information associated with the photographic material is in machine-readable form.

4. The method of claim 3 wherein said information is a machine-readable bar code.

5. The method of claim 3 wherein said information is a machine-readable magnetic recording.

6. The method of claim 1 wherein said information associated with said photographic material is silver coverage information.

7. The method of claim 1 wherein said information associated with said photographic material is on said photographic material.

8. The method of claim 1 wherein said replenishment chemistry is developer replenishment chemistry, and said algorithm comprises terms relating to the degree of exposure of said photographic material and the area of said material processed in unit time.

9. The method of claim 1 wherein said replenishment chemistry is fixer or wash replenishment chemistry.

10. The method of claim 1 wherein said replenishment chemistry is stabilizer, bleach or bleach-fix replenishment chemistry.

11. The method of claim 1 carried out in a minilab processor.

12. The method of claim 1 wherein said photographic material is a color negative photographic film contained in a film cassette.

13. A method of processing a photographic material in a photographic processing apparatus comprising contacting said material with a processing solution, and replenishing said processing solution with replenishment chemistry at a rate that is controlled by using an algorithm wherein at least one of the terms of said algorithm is determined by information associated with said photographic material, which information is silver coverage, silver halide ratio, gelatin coverage, coupler coverage, or inhibitor coverage, wherein said photographic material is supplied within a container, and said information associated with said photographic material is present on said container.

14. The method of claim 13 wherein said information associated with said photographic material is silver coverage.

15. The method of claim 13 comprising controlling the replenishment rate of more than one processing solution using an algorithm.

16. The method of claim 13 wherein said photographic material is a graphic arts material.

17. The method of claim 16 wherein said photographic material comprises a silver chloride or silver chlorobromide emulsion having a silver coverage of from 1 to 10 g/m$^2$, and a contrast index of from 1 to 30.

18. The method of claim 16 wherein said photographic material comprises an emulsion layer having two or more emulsion grain types.

* * * * *